US005520113A

United States Patent [19]

Joss et al.

[11] Patent Number: 5,520,113

[45] Date of Patent: May 28, 1996

[54] METHOD OF REGULATING DAMPENING MEDIUM

[75] Inventors: Werner Joss, Linkenheim; Josef Haase, Neckargemünd; Helmut Kipphan, Schwetzingen, all of Germany

[73] Assignee: Heidelberger Druckmaschinen AG, Heidelberg, Germany

[21] Appl. No.: 962,991

[22] Filed: Oct. 19, 1992

Related U.S. Application Data

[63] Continuation of Ser. No. 755,438, Sep. 5, 1991, abandoned, which is a continuation-in-part of Ser. No. 491,181, Mar. 9, 1990, abandoned.

[30] Foreign Application Priority Data

Mar. 9, 1989 [DE] Germany ..... 39 07 584.2
Sep. 5, 1990 [DE] Germany ..... 40 28 083.7

[51] Int. Cl.[6] ..... B41F 7/24

[52] U.S. Cl. ..... 101/484; 101/148

[58] Field of Search ..... 101/147, 148, 101/DIG. 45, 350, 365, 483, 484

[56] References Cited

U.S. PATENT DOCUMENTS 3,536,006 10/1970 Roozee .
3,700,984 10/1972 Rouse .
3,946,297 3/1976 Bechtel .
4,140,056 2/1979 Mabrouk ..... 101/148

FOREIGN PATENT DOCUMENTS 0126613 11/1984 European Pat. Off. ..... 101/148
0162243 12/1986 Japan ..... 101/148

OTHER PUBLICATIONS

Publication Proceedings of the 17th International Conference of Printing Research Institutes, Saltsjöbaden, Sweden, Jun. 1983 "Advances in Printing Science, etc." pp. 206–227.

*Primary Examiner*—J. Reed Fisher
*Attorney, Agent, or Firm*—Herbert L. Lerner; Laurence A. Greenberg

[57] ABSTRACT

Method of regulating an amount of dampening medium on a printing plate of an offset printing machine, includes determining the amount of dampening medium on the printing plate, adjusting the rotational speed of a dampening ductor and/or the like to a given set value so as to regulate the amount of dampening medium on the printing plate and, for regulation deviations wherein the set value is greater than an actual value, driving a controller with a greater amplification factor than for regulation deviations wherein the set value is smaller than the actual value.

29 Claims, 6 Drawing Sheets

DISK DRIVE
COMPUTER
MEASUREMNT. RECORDING UNIT
DATA
EVALUAT. CIRCUIT
1
2
3
4
5
5'
6
7
8
9
10
11
12
13
14
15
16
17
18
19
20
21
22

SW
29
28
+
+
27
PRINTING PLATE
26
DAMPENING UNIT
15
SENSOR
ΔUM
33
UR
ΔUM
UK
25
+
+
30
MEASUREMENT VALUE PROCESSING UNIT
32
KR
Xd
24
KR
CONTROLLER
Xd
SW ACT
23
-
+
SW SET

METHOD OF REGULATING DAMPENING MEDIUM

This application is a continuation of application Ser. No. 755,438, filed Sep. 5, 1991, now abandoned, which is a continuation-in-part application of Ser. No. 491,181, filed Mar. 9, 1990, now abandoned.

The invention relates to a method of regulating the amount of dampening medium or the thickness of a layer of dampening medium on a printing plate of an offset printing machine, the amount or layer thickness of dampening medium on the printing plate being determined and regulated by adjusting the rotational speed of the dampening ductor and/or the like to a given nominal or set value.

In offset printing technology, the feed of dampening medium is a decisive factor in the quality of the print. A problem which arises in this regard is the adjustment or adaptation of the amount of dampening medium to suit changing conditions of production. Among other things, the amount of dampening medium has a very great effect upon the increase in tonal value and, therefore, it is very important that the amount of dampening medium be optimally adjusted in accordance with the respective operating condition.

From the literary reference, namely, the periodical "Deutscher Drucker" ("German Printer") No. 13, 1986, p 235 ff., a method of regulating dampening medium in offset printing has become known, wherein the amount of dampening medium on the printing plate is registered or determined, and regulated at a given set value by adjusting the rotational speed of a dampening ductor. A nominal or set value for the moisture is derived from an empirically compiled table of set values, based on values experienced for various combinations of plate and paper, in particular from previously printed runs. This conventional regulating method is not yet optimal with respect to the performance of the method and the work product.

The aforesaid control process for dampening control has, however, a drawback in that the set values of the dampening medium are not being taken into account during the printing process.

It is accordingly an object of the invention to provide a method of the foregoing general type, which results in excellent regulation behavior, and particularly in optimal speed without any problems of instability. Furthermore, the amount of dampening medium should remain largely constant even when large disturbance values are introduced.

With the foregoing and other objects in view, there is provided, in accordance with one aspect of the invention, a method of regulating an amount of dampening medium on a printing plate of an offset printing machine, which comprises determining the amount of dampening medium on the printing plate, adjusting the rotational speed of a dampening ductor and/or the like to a given set value so as to regulate the amount of dampening medium on the printing plate and, for regulation deviations wherein the set value is greater than an actual value, driving a controller with a greater amplification factor than for regulation deviations wherein the set value is smaller than the actual value.

In accordance with another aspect of the invention, there is provided a method of regulating the thickness of a layer of dampening medium on a printing plate of an offset printing machine, which comprises determining the thickness of the layer of dampening medium on the printing plate, adjusting the rotational speed of a dampening ductor and/or the like to a given set value so as to regulate the thickness of the layer of dampening medium on the printing plate and, for regulation deviations wherein the set value is greater than an actual value, driving a controller with a greater amplification factor than for regulation deviations wherein the set value is smaller than the actual value.

The invention has the further object to provide a method as described above, to insure that a continuous follow-up control of the actual values of the amount of the dampening medium takes place during printing.

Due to the method according to the invention, it is possible to select the nominal or set value for the amount or layer thickness of dampening medium relatively close to or substantially at a so-called slurring limit. By the term slurring limit, there is understood to mean that precise condition of an amount of dampening medium at which ink-free i.e. non-inked, locations on the printing plate begin to acquire ink, which results in the production of waste. Despite the adjustment of the set value to a value close to or substantially at the slurring limit, no undesirable condition is arrived at due to the regulating method according to the invention. There is no danger of water runs, i.e., of a condition wherein there is too great an amount of dampening medium. Due to varying the amplification factor in accordance with the invention, a strong reaction of the controller to the critical state of too small an amount of dampening medium present is achieved, on the one hand, thus reducing the aforementioned danger of slurring. On the other hand, due to the use of the smaller amplification factor in the case of an excessive amount of dampening medium, the danger of instability of the regulating circuit is also avoided.

The method according to the invention also makes is possible to select the set value for the dampening medium close to the so-called slurring value. The term slurring value is defined as the condition at which the dampening medium value is such that the ink-free parts of the image just barely begin to accept ink, which leads to faulty printing.

Furthermore, the continuous monitoring of the slurring value insures that the dampening medium setting remains at its previously set value at all times during the continued printing.

Experiments or testing with the regulating method according to the invention have shown that, when a disturbance value comes into play, the regulation exhibits excellent quality. Due to the very fast reaction of the controller effected by the relatively high amplification factor, the reducing thickness of the water film caused by the disturbance value does not result in the process-limit parameters being exceeded. Due to the smaller amplification factor then present, in accordance with the invention, the instant the effect of the disturbance value ceases, a somewhat longer transition between conditions is non-critical because there is no danger of slurring and water runs, respectively, at this location. At the same time, however, an over-reaction (overshoot) by the controller is also avoided, and the danger of continuous oscillations is likewise eliminated. In addition, the operating behavior of the controller when sudden leaps in the set value (upwards or downwards) occur is extraordinarily good due to the configuration according to the invention. As a whole, the regulating system according to the invention permits adjustment to a nominal or set value which is favorable for the print quality and, simultaneously, regulation in critical regions is performed with an extraordinarily fast reaction, but nevertheless in a manner that stable states or conditions are introduced or instituted. The correspondingly slower reaction resulting from the smaller amplification factor (base amplification factor), for the instance wherein the set or nominal value is smaller than the actual value, also leads to a stable, non-critical situation.

Experiments and tests with the control process according to the invention have shown that by influx of disturbances, the control maintains excellent image quality. Such an influx of disturbance causing reduced water film thickness avoids, due to the relatively high amplification factor and the rapid response, that the process limits are exceeded. As soon as the disturbance has passed, due to the now smaller amplification factor, according to the invention, the longer lasting change in the condition is uncritical, since in this case there is no danger of slurring or creation of "water noses". At the same time, it is also avoided that over-reaction of the controller takes place, as well as the danger of sustained oscillations. Additionally, the control is very responsive to step-changes in the set values (both upward and downward), due to the particular features of the invention.

Summarizing, the control system according to the invention makes it possible to maintain optimal printing quality. At the same time, the control is capable of responding very quickly in critical areas, and still maintain stable conditions. Due to the lower value of the amplification factor (the basic amplification factor) in cases wherein the set value is lower than the actual value, the corresponding slower controller reaction leads also to stable, uncritical operation.

In accordance with another mode of the method invention, the greater amplification factor is approximately 1.2 to 2, but preferably 1.5, times as great as the base amplification factor. These values have proven to be particularly desirable.

In accordance with a further mode, the method according to the invention includes performing a regulation effecting a variation in an adjustment value only when a difference between the set value and the actual value is outside a given tolerance range. The controller then only effects a variation in the control voltage when the given tolerance range has been exceeded. The controller operates, as it were, with a hysteresis. This manner of operation has the advantage that stochastic variations in the measurement signal (actual value and a value dependent thereon, respectively) are not taken into account, so that the controller is not engaged uselessly and, furthermore, the adjusting equipment is preserved by being subjected to less demands or a lower level of stress. Due to the aforementioned sign-related selection of the amplification factor (set value greater than actual value: then amplification factor large; set value smaller than actual value: then amplification factor small), a prompt and well-metered reaction of the controller is attainable despite the tolerance range regulation described, without the occurrence of impermissible drift away from the relevant values.

In accordance with an added mode, the method according to the invention includes superimposing on the regulation a control for compensating for a disturbance value of known effect.

A consequence of this mode of the method is that disturbance value effects of known type do not have to be compensated entirely by means of the regulation circuit, but rather, the respective compensation of the disturbance value or disturbance values ensures that all of the essential parameters are adjusted to a new operating state or condition. Thus, the regulating system always remains active, even during the compensation step. Disturbance values equalized by the described compensation may, for example, be variations in the speed of printing, ink feed temperature or air flow, as well. The aforementioned disturbance value compensation is preferably realized by superimposing on the controller output value compensation values determined from a measurement of disturbance values having a known effect upon the feed of the dampening medium.

A compensation value which results from the measurement of one disturbance value only may be superimposed as the controller output value. If several disturbance values are to be compensated for, a corresponding number of measurements are taken, and a corresponding number of compensation values to be superimposed will result.

In accordance with other modes of the invention, the method includes additionally, or alternatively, calculating the compensation value, or deriving it from stored tables and characteristic curves, respectively. Such tables or characteristic curves can, for example, be stored in the memories of appropriate process control computers. The calculation of the compensation value can also be performed by a computer.

In accordance with yet another mode, the method according to the invention includes selecting the set value substantially at a slurring limit of a printing process performed by the offset printing machine.

In accordance with a concomitant mode of the invention, the method includes optically determining by measuring light reflection the actual value representing a measurement of the amount of dampening medium or the thickness of the layer of dampening medium.

Other features which are considered as characteristic for the invention are set forth in the appended claims.

Although the invention is illustrated and described herein as embodied in a method of regulating dampening medium on a printing plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 7:
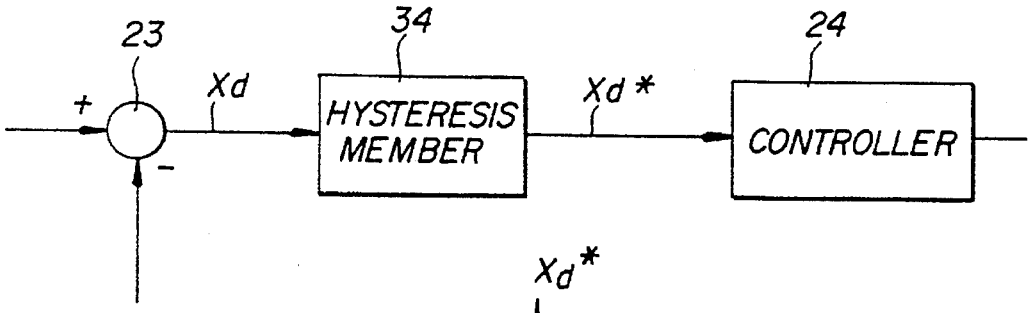
FIG. 7 is a block circuit diagram.
Figure 7A:
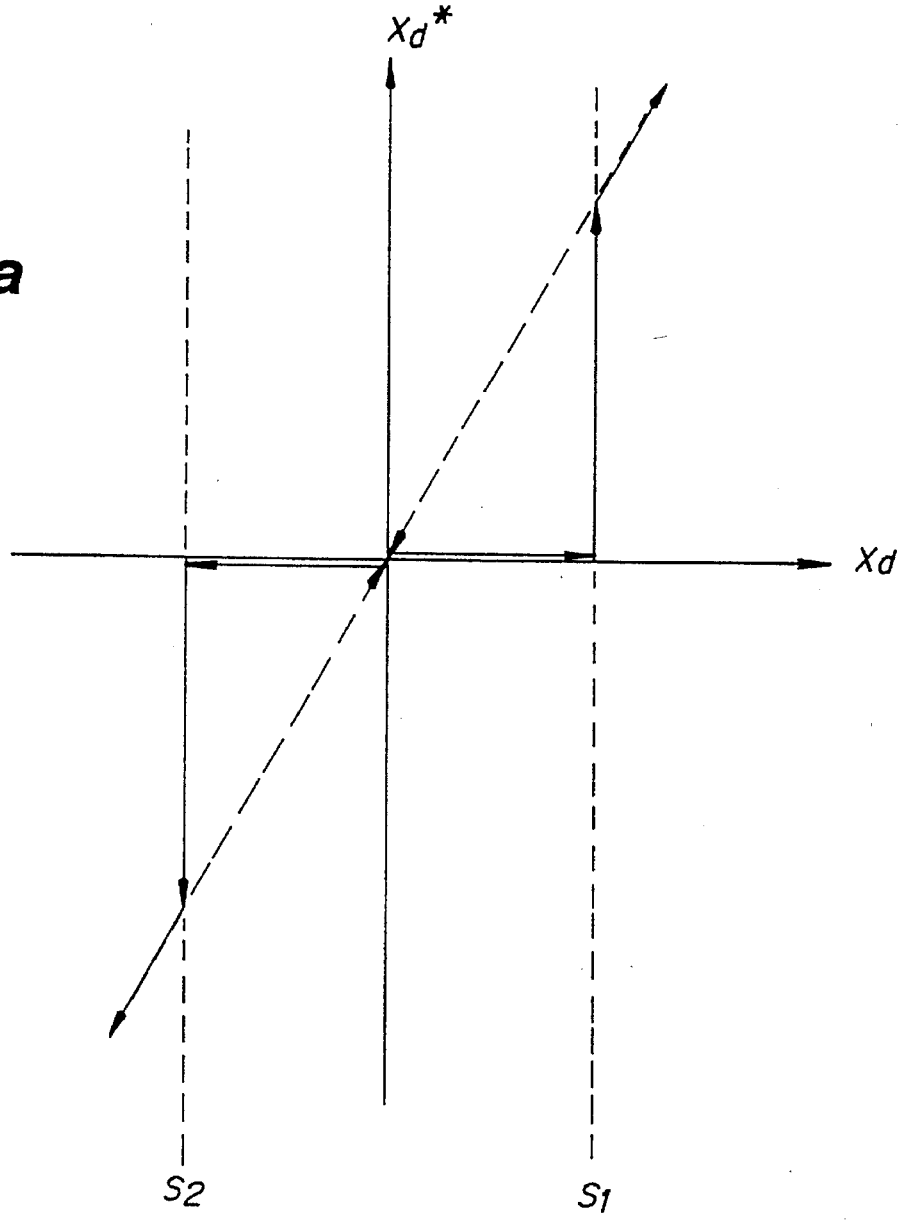
Figure 8:
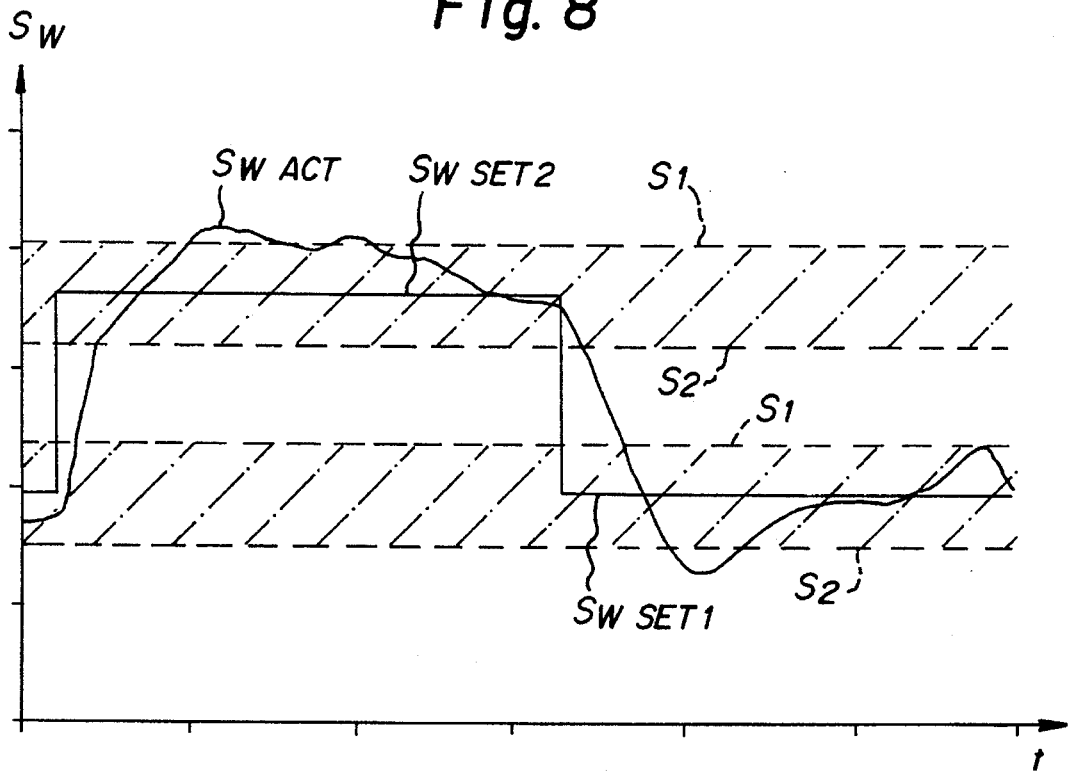
Figure 9:
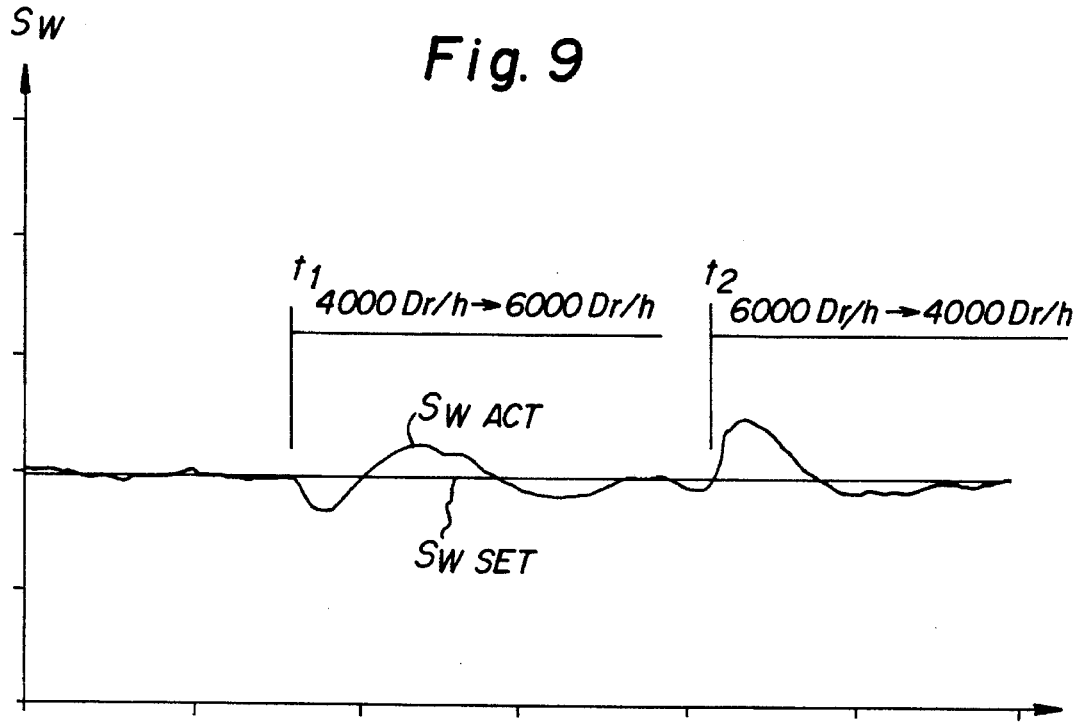

FIG. 7*a* is a plot diagram for the configuration of FIG. 7, with a tolerance range for set and actual values;

FIG. 8 is a plot diagram showing a variation in curve behavior upon the occurrence of a leap or jump in the set value, further taking into account the tolerance range for set and actual values; and FIG. 9 is a plot diagram of the rate of change, if any, of set and actual values with compensation for a known disturbance value effected by a superimposed control.

Figure 1:
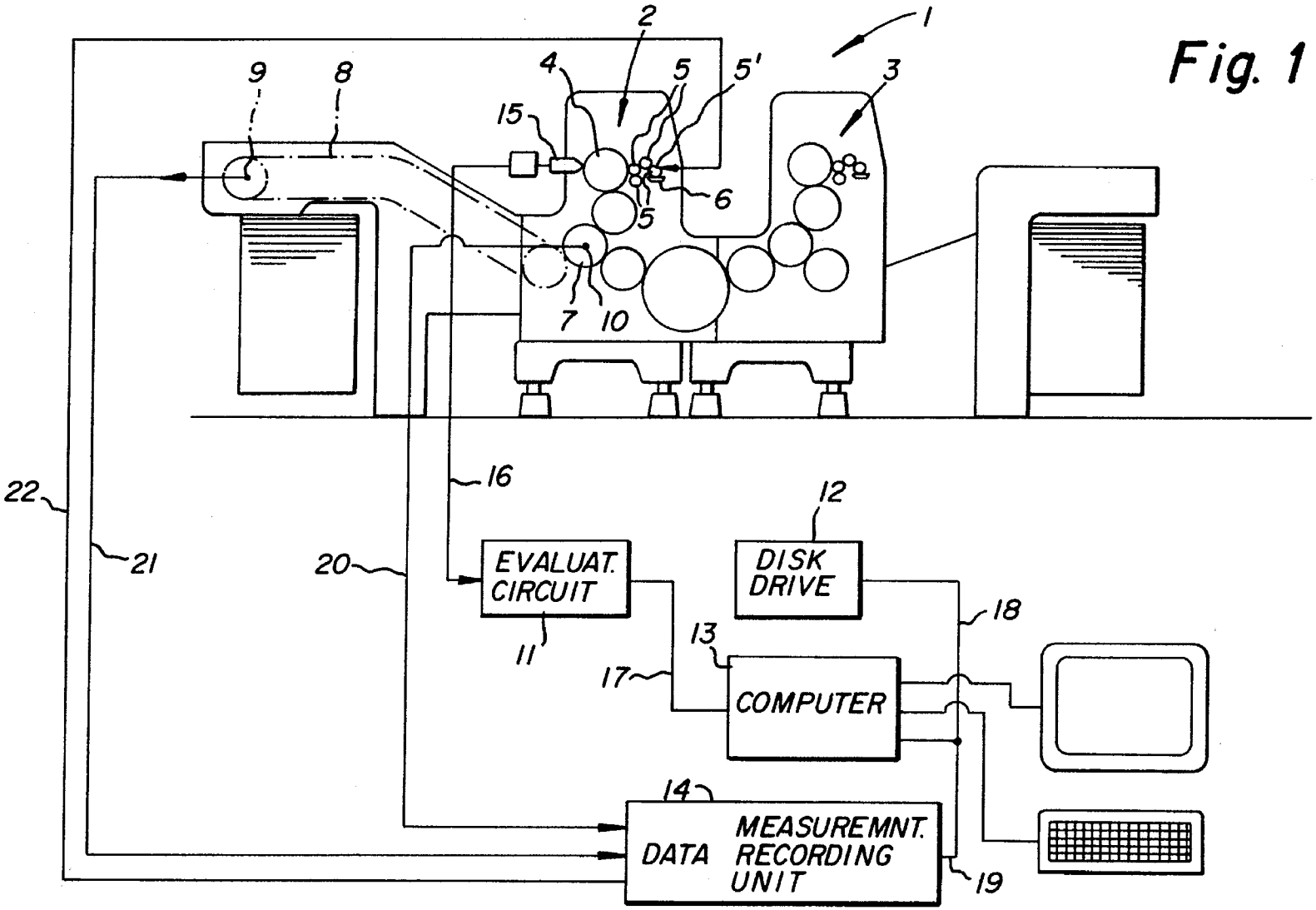
FIG. 1 is a diagrammatic front elevational view of an offset printing machine and a schematic block diagram of a regulating system for implementing the method of regulating dampening medium on a printing plate in accordance with the invention.

Referring now to the drawing and, first, particularly to FIG. 1 thereof, there is shown therein diagrammatically and schematically the structure for performing the method of regulation according to the invention. FIG. 1 thus illustrates an offset printing machine 1, a printing unit 2 and another printing unit 3. Only the printing unit 2 will be described hereinbelow, together with the regulating system therefor.

It is understood, however, that the printing unit 3 is likewise equipped with a corresponding regulating system.

A number of non-illustrated inking cylinders and, in addition, several dampening rollers 5 and 5' are assigned to a plate cylinder 4 of the printing unit 2 which has a printing plate disposed thereon. The dampening roller 5' cooperates with a dampening-medium reservoir 6. The rotational speed of the dampening roller 5', which is in the form of an immersion or dipping roller, is variable. The rotational speed is taken or measured from an impression cylinder 7 of the printing unit 2 via an active connection 8, in the form of a sheet delivery, for example, and transferred to a tacho-generator 9. The impression cylinder 7 is provided with a shaft encoder 10, which registers the angular setting or position of the impression cylinder 7.

Additionally, the following peripheral devices are illustrated in FIG. 1: an evaluation circuit 11, a disk drive 12, a computer 13 and a measurement-data recording unit 14. In order to determine the thickness of the layer of dampening medium, the surface of the printing plate mounted on the plate cylinder 4 is optically scanned by a conventional sensor 15, which is connected via a lead 16 to the evaluation circuit 11. The evaluation circuit 11 is connected via a connecting line 17 to the computer 13. The computer 13 is connected via leads 18 and 19 to the disk drive 12 and the measurement-data recording unit 14, respectively. The shaft encoder 10 is connected via a lead 20 to the measurement-data recording unit 14, and the tacho-generator 9 is also connected to the measurement-data recording unit 14 via a lead 21. Finally, a lead 22 runs from the measurement-data recording unit 14 to a non-illustrated drive for the dampening roller 5'.

Roughly described hereinafter is a performance of the method according to the invention:

The sensor 15 determines the thickness of the dampening medium on the printing plate and transmits this information to the evaluation circuit 11, which performs an appropriate data processing operation. The actual value of the thickness of the dampening-medium layer or film is compared with a given set value $S_{w\ set}$, which is selected so that it is relatively near the so-called slurring limit. This slurring limit indicates that value of the amount of dampening medium, and that value of the thickness of the dampening-medium layer, respectively, at which ink-free or non-inked locations on the printing plate begin to take on ink. Advancing or presupposing a set value of this type has the advantage that excellent printing results are achieved. The peripherals or peripheral devices of the offset printing machine 1 then form a regulating circuit, described hereinafter in greater detail, which is of such construction that a deviation from the thickness of dampening-medium layer (actual value), which is registered by the sensor 15, when compared in a summing location 23 (FIG. 2) with the given set or nominal value $S_{w\ set}$ results in an adjustment of the rotational speed of the dampening roller 5' (regulation of the rotational speed of the immersion or dipping roller). According to the invention, the performance of the regulating method calls for a controller 24 having an input $X_d$ connected to the summing location 23. This controller is arranged to operate with varying amplification factors, depending upon the respective condition of gain control input $K_R$. Furthermore, as is also apparent from FIG. 1, an effect which is dependent upon the speed of printing is provided; this effect takes place, for example, due to the feeding of a tacho-voltage from the tacho-generator 9 to the measurement-data recording unit 14 via the lead 21. The details regarding the foregoing are explained hereinafter. A measurement demand is sent when a given machine setting is reached (counted in degrees and pulses, respectively), so that the measuring head 15 takes the measurement at the location provided on the printing plate for this purpose. A zero pulse serves for resetting a counter, and a pulse count serves for determining the instantaneous machine setting.

Figure 2:
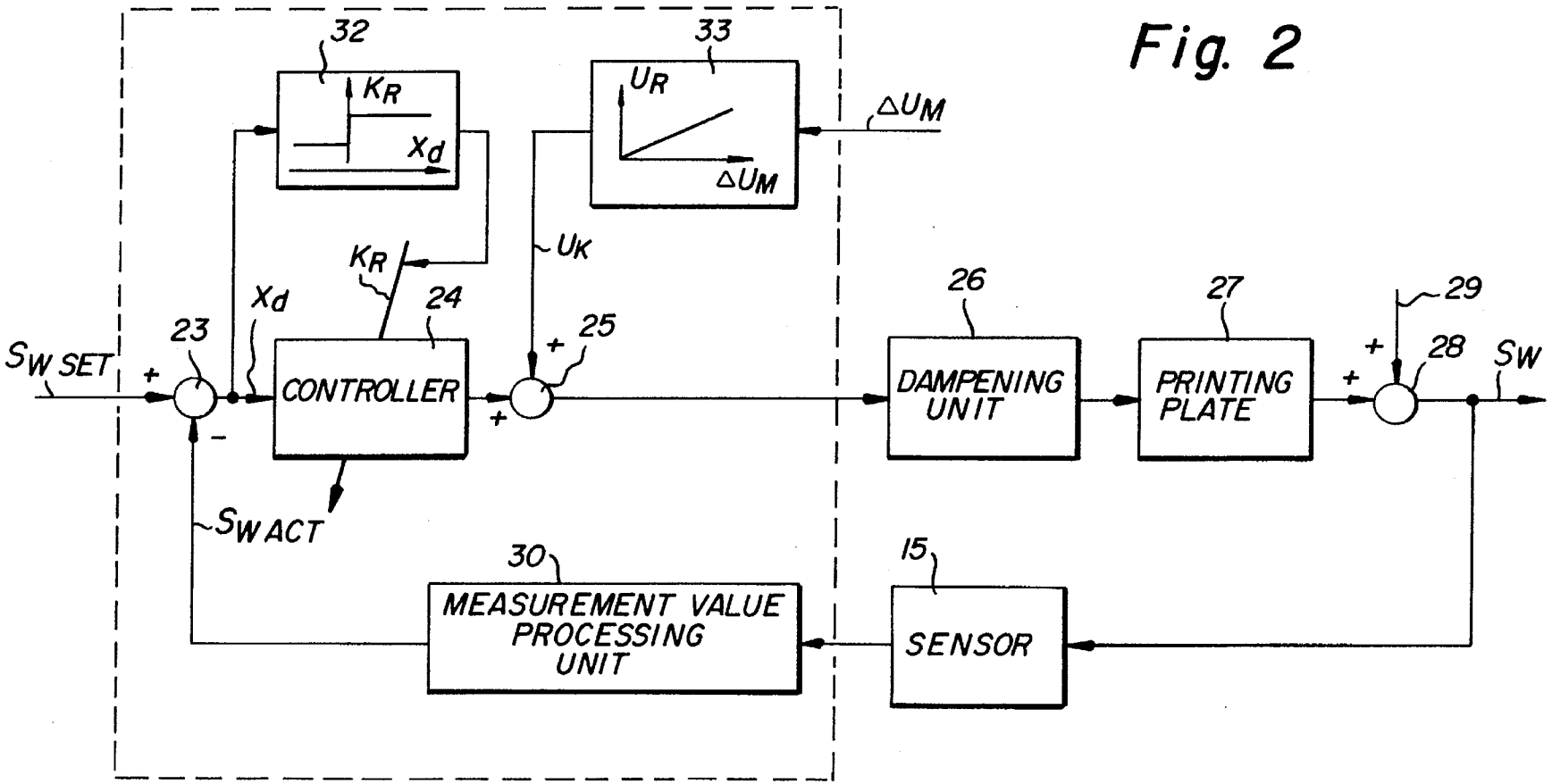
FIG. 2 is a detailed block diagram of the regulating circuit.

FIG. 2 is a block circuit diagram of the hereinafore-described regulating circuit. The set value for the quantity of dampening medium (and thickness of a layer of dampening medium, respectively) $S_{w\ set}$ is fed to a summing location 23. Simultaneously, the actual value of the quantity of dampening medium (and the thickness of the layer of dampening medium, respectively) $S_{w\ act}$ is likewise fed with a negative sign to the summing location 23. The difference resulting from these two values (control deviation $X_d$) $S_{w\ set}—S_{w\ act}$ is fed to a controller 24. The controller 24 is a proportional-integral controller, i.e., a PI controller and is a standard component readily available in the marketplace. This hardware is suitably replaceable by a computer utilizing software in the form of a programmed PI velocity algorithm which is also commercially available. The output of the controller 24 is connected via a summing location 25 to a dampening unit 26 of the offset printing machine 1. The rotational speed of the immersion roller of the dampening unit 26 is adjusted in accordance with the output value of the controller 24. The block shown next to the dampening unit 26 represents the printing plate 27, which is located on the plate cylinder 4 of the offset printing machine 1. Connected to the printing plate 27 is a further summing location 28 which has an output value $S_w$, which incorporates the real thickness of the layer of dampening medium on the printing plate. The arrow 29 pointing to the summing location 28 indicates disturbance variables which affect the thickness of the layer of dampening medium. These disturbance variables may result, for example, from air movements, ink tracking or follow-ups or temperature variations.

The thickness of the dampening-medium layer on the printing plate 27 is registered by the sensor 15, which feeds its data to the evaluation circuit 11, which is represented (among other elements) by a block 30 (measurement-value processing and averaging) in FIG. 2. The output of the measurement-value processing is the actual value $S_{w\ act}$ which is conducted to the summing location 23. The measurement-value processing unit is based essentially upon the particular type of sensor. Thus, a measurement-value processing unit which may be used is the unit described in application Ser. No. 252,644 filed Sep. 20, 1988, for example. Moreover such units are readily available in the marketplace, such as that known as Rodenstock RM500 which is manufactured by Optische Werke G. Rodenstock of Munich, Germany.

The control deviation $X_d$ is fed also to a block 32, which represents a circuit exerting an influence upon the controller 24 in that the amplification factor $K_R$ is influenced. According to the invention, in the event the set value $S_{w\ set}$ is greater than the actual value $S_{w\ act}$, a greater amplification factor will be used than for control deviations wherein the set value $S_{w\ set}$ is smaller than the actual value $S_{w\ act}$. Preferably, the higher amplification factor is about 1.5 times as great as the lower amplification factor (base amplification factor). The controller 24 is preferably constructed as a PI controller (i.e. proportional-integral controller).

FIG. 2 also shows a compensation circuit 33 which can, for example, perform a speed compensation, that is, it can exert an influence upon the printing process parameters, brought about by varying the printing speed. Values other than disturbance variables, however, can also be taken into account for compensation. All disturbance variables having a known effect are possible, so that their effects can be recorded by means of measurement, calculation or retrieval from tables and characteristic curves, respectively. Returning to the embodiment of the invention according to FIG. 2, any variation in speed $DU_M$ of the printing process is fed to the compensation circuit 33. This is represented by the arrow $DU_M$.

A dampening-unit compensation-characteristic curve serves for determining a value $U_K$, which represents a voltage to speed compensation. This voltage is fed to the summing location 25. The result of such an arrangement is that variations in the printing speed do not have to be equalized or evened out by the regulating circuit, but rather, this speed compensation is superimposed on the regulating circuit as a control. By means of this combination of regulation with the compensation device (compensation circuit 33), a considerably more constant feeding of dampening medium is achieved than would be the case if such disturbance variables were compensated for by regulation instead of by the control intervention.

According to the invention, a deviation from the set value is evened out considerably more quickly in this manner. Compensation devices known from the state of the art which operate purely as controls have the disadvantage that additional disturbance variables are not evened out or equalized because of the lack of a regulation system. This does not come to bear in the arrangement according to the invention due to the superimposition of the control on the regulating system.

According to the invention, a different regulation characteristic for regulation deviations greater and less than zero, respectively, is provided, in accordance with the foregoing comments, by the use of varying amplification factors $K_R$, Such a regulating system can preferably be overridden by the hereinaforedescribed compensation procedure, as a control, for disturbance values with known effect. The aforementioned greater amplification factor is preferably selected to be 1.5 times as great as the base amplification factor.

With regard to the configuration of the sensor 15, the following is to be noted as an example:

This sensor 15 has an illumination device, which casts light, directed via an illuminating optical system, onto the surface of the printing plate. The light reflected by the printing plate is registered by a line of photoelectric diodes. Through the use of the photo-diode line, it is possible to measure the entire light distribution along the length of the line. A characteristic value $S_w$, corresponding to the amount of dampening medium and the thickness of the layer of dampening medium, respectively, is calculated in the evaluation circuit 11 from the radiation intensities determined at individual diodes of a line of photoelectric diodes.

Figure 3:
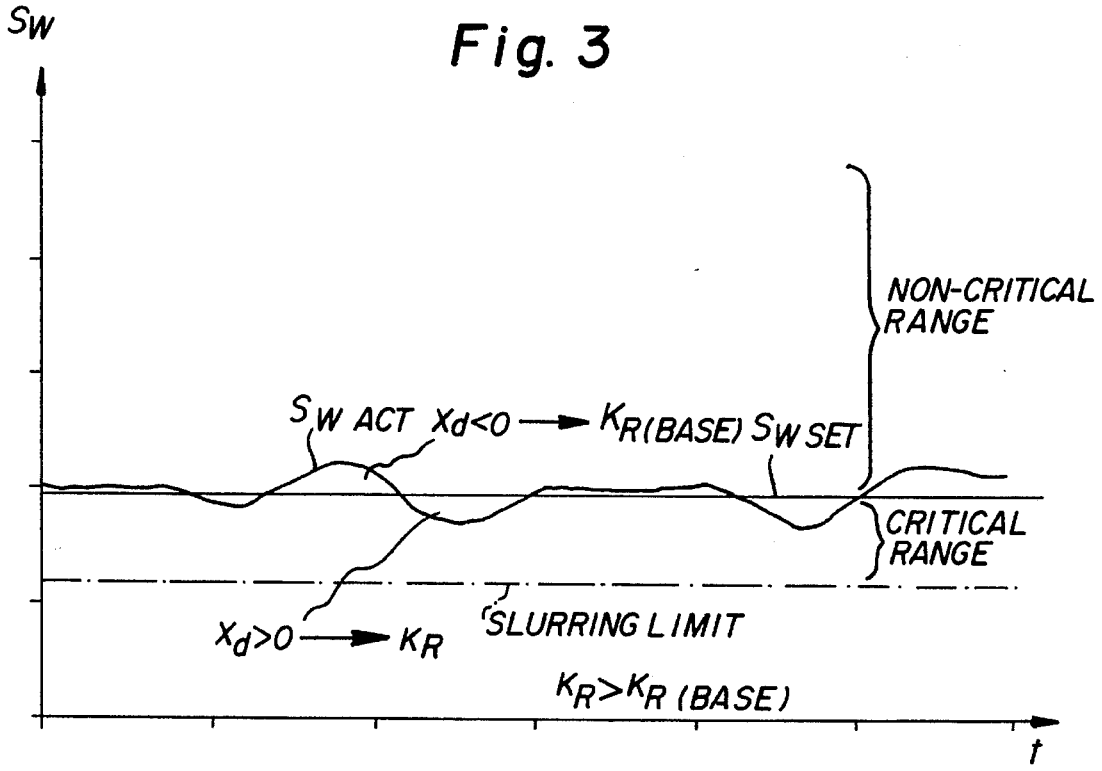
FIG. 3 is a plot diagram of the rate of change, if any, per time of set or nominal values and actual values in relation to a slurring limit.

FIG. 3 is a plot diagram with time t represented on the abscissa, and the thickness $S_w$ of the layer of dampening medium on the ordinate. The slurring limit is shown as a phantom line. In accordance with the invention, the set value $S_{w\ set}$ for the thickness $S_w$ of the layer of dampening medium extends across the diagram above this slurring limit. The actual value $S_{w\ act}$ of the thickness of the layer of dampening medium varies in the course of time about the set value $S_{w\ set}$, it being readily apparent that regulation deviations greater and smaller than zero occur, for example, because of the influence of disturbance values: that is, wherever the set value $S_{w\ set}$ is greater than the actual value $S_{w\ act}$, a regulation deviation greater than 0 is present, which leads to the use of an increased amplification factor, and wherever the set value $S_{w\ set}$ is smaller than the actual value, the regulation deviation acquires a value less than zero, leading to the use of an amplification factor which is smaller than that described in the preceding case. These varying states or conditions are represented in FIG. 3.

It can furthermore be seen from FIG. 3 that a critical range is formed between the set value $S_{w\ set}$ and the slurring limit, i.e., regulation oscillations occurring within this by slurring or smearing. Above the set value $S_{w\ set}$ lies a range or region run the risk of spoiling the printed product so-called non-critical region. If the actual value $S_{w\ act}$ is located in this non-critical region or zone, more water than is required is present on the printing plate, however, this state is not so critical for impairment of the printed product. According to the invention, in order to leave the critical area as rapidly as possible, an amplification factor for the controller 24, which is increased relative to the base amplification factor is provided. If the non-critical region is approached, it is permissible for the performance of the process to introduce a smaller amplification factor thereat, so that, in fact, leaving the non-critical region occurs more slowly, which, however, as described hereinbefore, is not coupled with any damaging effects upon the print.

Figure 4:
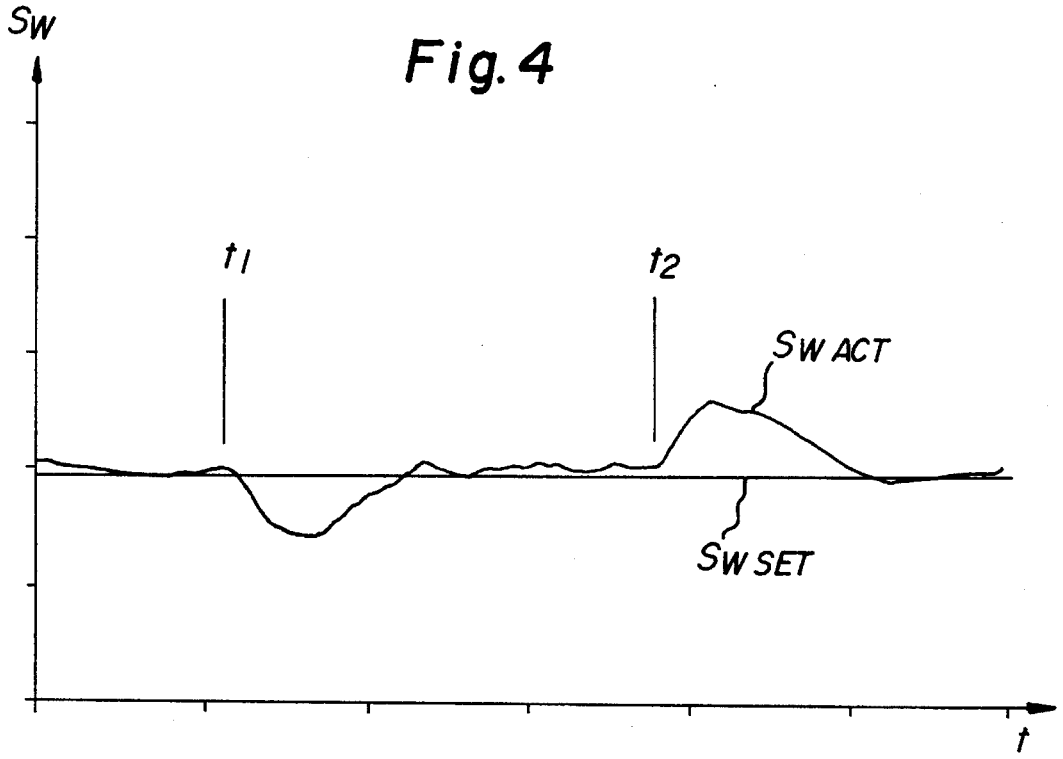
FIG. 4 is a plot diagram of the rate of change, if any, per time of the set values and actual values when disturbance values are introduced.

FIG. 4 shows respective curves of the set value $S_{w\ set}$ and actual value $S_{w\ act}$ over time t when a disturbance value is superimposed thereon. For example, to perform the test or run, at a time $t_1$, a flow of air produced by a blower is directed onto the surface of the printing plate, i.e., the evaporation of the dampening medium is accelerated. As a result, the thickness of the water film reduces, with the danger of entering the slurring region. Due to the increased amplification factor, in accordance with the invention, however, this tendency is countered with a swift reaction, so that within a very brief lapse of time, the actual value $S_{w\ act}$ again moves towards the nominal or set value $S_{w\ set}$, and resumes running approximately parallel adjacent to the latter. At a time $t_2$, the disturbance value is eliminated; that is, in the described test, the air flow is interrupted. Accordingly, the thickness of the dampening-medium film on the printing plate will increase initially, so that the actual value $S_{w\ act}$ exceeds the set value $S_{w\ set}$. The controller 24 accordingly operates in the non-critical region (note FIG. 3), only the base amplification factor $K_R$ being introduced. With a corresponding time constant, the actual value $S_{w\ act}$ then moves again in the direction of the set value $S_{w\ set}$.

Figure 5:
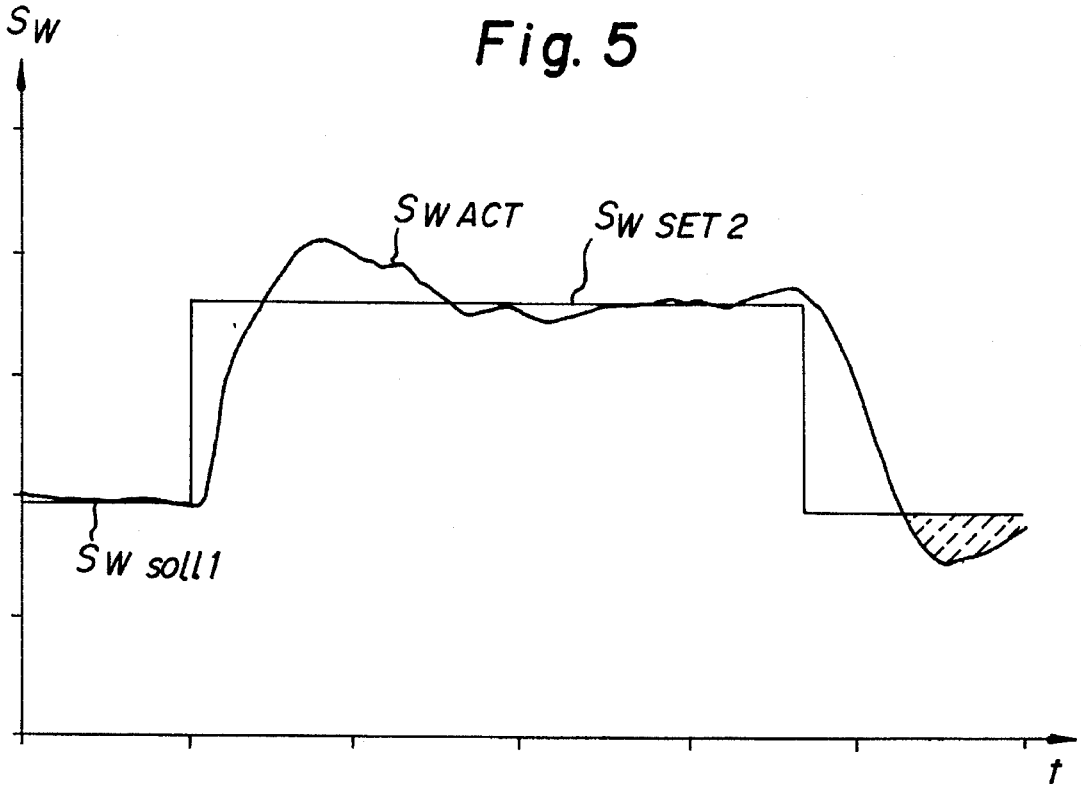
FIG. 5 is a plot diagram corresponding to that of FIG. 3 showing a variation in curve behavior upon the occurrence of a leap or jump in the set or nominal value.

FIG. 5 shows the actual and set values $S_{w\ act}$ and $S_{w\ set}$, and $S_{w\ set}$, respectively, over time t for the representation of the conduct of the regulating system according to the invention.

In this mode, a sharp leap in the set value is pre-set. When the set value $S_{w\ set1}$ leaps to the larger value $S_{w\ set2}$, the follow-up of the controller 24 occurs very rapidly, because the operation is performed thereat with the greater amplification factor. The region in which the set value $S_{w\ set2}$ leaps back to the set value $S_{w\ set1}$ is critical. A situation then briefly exists wherein the set value is smaller than the actual value, i.e., the operation is being performed with an amplification factor $K_R$ which corresponds to the base amplification factor. Accordingly, the processes occur correspondingly more slowly, it being nevertheless possible, by selecting the size of the base amplification factor, for the inevitable or unavoidable overshoot (shown in FIG. 5 as a dotted region) not to be so extensive that the slurring limit is exceeded. In actual practice, the danger of slurring is even further reduced by not allowing such changes in set values to take effect instantaneously and completely, but rather, gradually. Suitable methods or means for accomplishing this are known to control technicians of even ordinary skill in the art.

Figure 6:
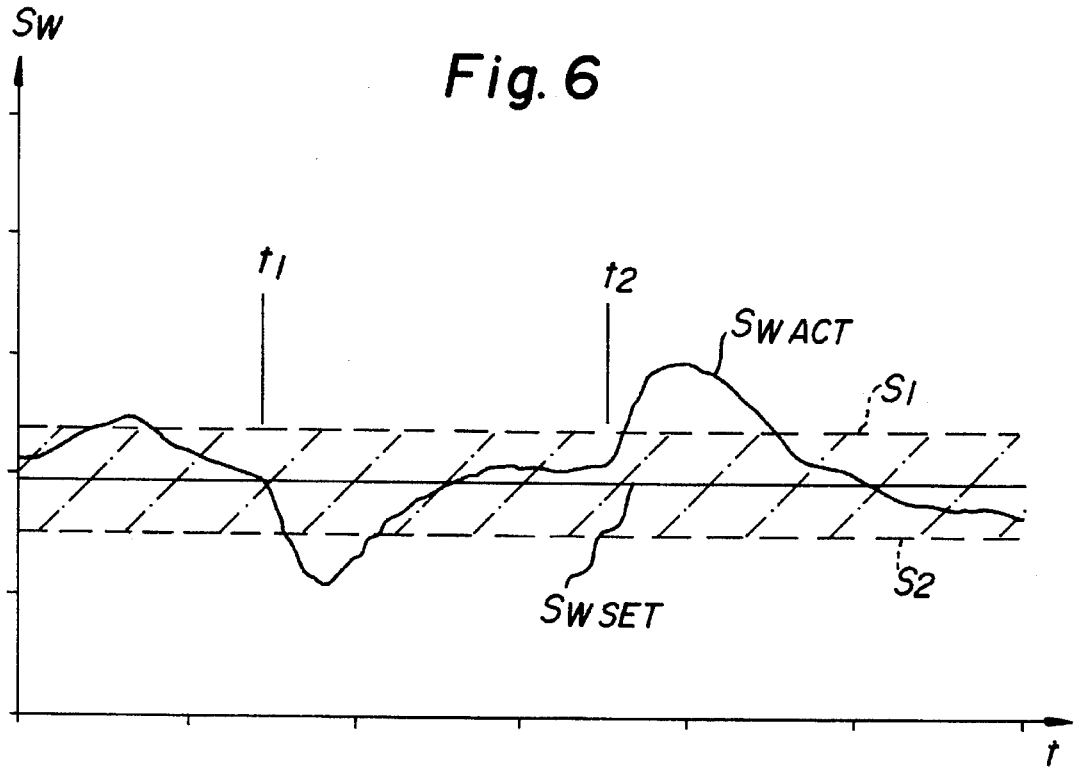
FIG. 6 is a plot diagram of the set and actual values when disturbance values are introduced and, taking into account a tolerance range for set and actual values.

FIGS. 6 to 8 relate to an operating mode of the regulating system according to the invention wherein a set value and actual value tolerance range are employed. This means that the controller 24 operates with a type of hysteresis, because its control voltage varies only when the difference between the set value and the actual value is outside of a given tolerance range. Accordingly, the controller reacts only with variations in the adjustment values when the given tolerance of the regulation deviation is exceeded. In particular, stochastic variations in the measurement signal are not taken into account which results in an equalization or standardization of the entire process.

According to FIG. 7, a hysteresis member 34 is wired between the controller 24 and the summing location 23. A regulation deviation $X_d$ is fed to the hysteresis component 32 as an input value, and a modified regulating value $X_{d*}$, leaves the device as output voltage. The hysteresis member 34 is available commercially as a hardware component. It may, however, preferably be in the form of software, in that a so-called hysteresis subprogram may thus be fed to the regulating deviation $X_d$. The functional connection between $X_d$ and $X_{d*}$ is apparent from the plot diagram of FIG. 7*a*. As the positive value $X_d$ increases, starting from the origin of the coordinates, the modified regulation deviation $X_{d*}$ remains at 0. Only when threshold value $S_1$ is exceeded does the modified regulation deviation $X_{d*}$ jump to a specified value, and increases from there onwards linearly with $X_d$. If the regulation deviation is reduced from starting point, the modified regulation deviation $X_{d*}$ also returns linearly to 0.

If the regulation deviation $X_d$ exceeds the value 0, that is, if it becomes negative, then a corresponding mirror-image behavior occurs. The value $-X_{d*}$ therefore experience a sharp leap only when the threshold value $S_2$ is exceeded.

Viewed as a whole, this configuration achieves the result that minor deviations between set value and actual value do not lead to an intervention by the controller, but rather that the controller intervenes only when the corresponding threshold values $S_1$ and $S_2$, respectively, are exceeded. This has a positive effect on the entire system.

FIGS. 6 and 8 correspond to FIGS. 4 and 5, however, with the controller operating with the aforedescribed hysteresis behavior. Due to this hysteresis operation, it is apparent from a comparison of the respective figures that fundamentally greater regulation deviations set in or occur, the process nevertheless being executed with adequate speed and stability, and with the advantage that the controller intervenes less frequently and, consequently, the adjustment devices are called upon to a lesser extent.

FIG. 9 shows the hereinafore-described effect upon actual and set values due to the compensation control overriding or being superimposed on the controller structure. For example, at the instant of time $t_1$, the print speed is increased from 4,000 sheets per hour to 6,000 sheets per hour whereas, at the instant of time $t_2$, a reduction of the print output from 6,000 prints per hour to 4,000 prints per hour occurs. Due to the speed compensation, as described hereinabove, only a relatively short, cushioned oscillation of the actual value $S_{w\ act}$ occurs around the set value $S_{w\ set}$, the controller having to intervene only minimally, because the essential parameter variations have been intercepted previously by the overriding or superimposed control. Viewed as a whole, optimal performance of the process can be achieved with the process according to the invention.

We claim:

1. Method of controlling the value of dampening medium on a printing plate of an offset printing machine, the printing machine which includes a plate cylinder for mounting the printing plate; a dampening medium ductor for applying the dampening medium to the printing plate; a dampening medium controller connected to the dampening ductor for controlling the value of dampening medium applied to the printing plate, the controller having an amplification factor control input, and an output amplification factor depending on the amplification factor control input, the amplification factor being variable between a greater amplification factor and a smaller amplification factor; and a dampening medium measuring device for measuring the value of dampening medium on the printing plate; the method which comprises the steps of:

(a) measuring with the dampening medium measuring device the value of dampening medium on the printing plate to obtain an actual dampening medium value;

(b) comparing the actual dampening medium value with a given desired dampening medium set value;

(c) determining the deviation $X_d$ between the desired dampening medium set value and the actual dampening medium value;

(d) entering the deviation $X_d$ into the amplification factor control input of the controller;

(e) setting the controller, in case the desired set value of the dampening medium is greater than the actual value of the dampening medium, to its greater amplification factor, and in case the set value of the dampening medium is smaller than the actual value, setting the controller to a smaller amplification factor, and (f) setting with the controller the dampening medium to the set value.

2. Method according to claim 1, which comprises the steps of setting the controller only when a difference between the set value and the actual value is outside a given tolerance range.

3. Method according to claim 1, wherein disturbances in dampening medium value are occurring, the method which includes the step of superimposing at the output of the speed controller a compensating value for compensating for the disturbances in dampening medium value.

4. Method according to claim 3, wherein the compensating value is resulting from a measurement of a disturbance value.

5. Method according to claim 3 including calculating apparatus having an output connected to the controller input, which includes the step of calculating the compensation variable automatically.

6. Method according to claim 3 including table and curve reading apparatus having an output connected to the controller input, which includes the steps of determining the compensation variable automatically from respective stored tables and characteristic curves.

7. Method according to claim 1, wherein the dampening value has a slurring limit which includes the step of selecting a set dampening value substantially at the slurring limit of a printing process performed by the offset printing machine.

8. Method according to claim 1, wherein the driven controller is a proportional integrating controller.

9. Method according to claim 1, including light reflection measuring apparatus for measuring reflected light, the method which further comprises the steps of optically determining by measuring with said light reflection measuring apparatus light reflection, the actual value of which representing the amount of dampening medium.

10. Method of controlling the value of a layer of dampening medium on a printing plate of an offset printing machine, the printing machine which includes a plate cylinder for mounting the printing plate; a dampening ductor for applying the layer of dampening medium to the printing plate, a dampening ductor speed controller for controlling the rotational speed of the dampening ductor so as to regulate the thickness of the dampening medium; a first summing circuit having a first input for receiving a set value of the dampening layer thickness, a second input for receiving an actual value of the dampening layer thickness, and an output for presenting a control deviation value to a control deviation input of the speed controller; the speed controller having an output connected to the dampening ductor for controlling the speed of the dampening ductor, the controller having a control deviation input for receiving the control deviation value, and an amplification factor control input, the controller having an amplification factor being controllable by said amplification factor control input between a greater amplification factor and a smaller amplification factor; a measuring device for measuring actual thickness value of the dampening medium having an output connected to the speed controller; the method which comprises determining with the measuring device the actual thickness value of the layer of dampening medium on the printing plate, setting the rotational speed of the dampening ductor to provide a set value of the thickness of the layer of dampening medium on the printing plate and, for subsequent deviations wherein the set value is greater than the actual thickness value, driving the controller with a greater amplification factor and for deviations wherein the set thickness value is smaller than the actual thickness value driving the controller with the smaller amplification factor.

11. Method according to claim 10 wherein the greater amplification factor is approximately 1.2 to 2 times as great as the smaller amplification factor.

12. Method according to claim 10, which comprises the steps of setting a tolerance range equal to a given difference between the set value and the actual value of the layer of dampening medium, and changing the rotational speed of the dampening ductor only when a difference between the set value and the actual value is outside the given tolerance range.

13. Method according to claim 10, which includes superimposing on the output of the controller a compensating signal for for compensating for a disturbance in the thickness of the layer of dampening medium of a known value.

14. Method according to claim 13, including a reading device having a memory for storing tables and characteristic curves for disturbance values, wherein the superimposed signal is comprised of a compensation variable superimposed on an output of the speed controller, the compensation variable resulting from a measurement from the reading device of a disturbance value.

15. Method according to claim 13, including a reading device for reading tables and characteristic curves having respective inputs for receiving the actual and the set value of the thickness of the dampening medium layer, and an output connected to the input of the controller, the method which includes the step of reading with the reading device the compensation variable from one of stored tables and characteristic curves.

16. Method according to claim 10, which includes the step of selecting the set value as a value substantially equal to a slurring limit of a printing process performed by the offset printing machine.

17. Method according to claim 10 wherein said speed controller is a proportional-integral-controller, further including the step of driving the controller as a proportional-integral controller.

18. Method according to claim 10, including an optical device for optically measuring reflected light from the layer of dampening medium, the method which includes optically determining by measuring with the optical device light reflection representing the actual value of the thickness of the layer of dampening medium on the printing plate.

19. Method according to claim 16, wherein during printing from time to time the slurring value is reached, and further comprising the steps of:

upon reaching the slurring value, measuring the corresponding dampening medium thickness, and applying the corresponding dampening medium thickness as the set value at the next following setting of the dampening medium.

20. Method of regulating the dampening medium on a printing plate of an offset printing machine having means for applying an amount of dampening medium to the printing plate, the printing machine which includes a printing cylinder for mounting the printing plate, measuring means for measuring the amount of dampening medium on the printing plate, and a controller having an input, a first summing location having a first input for receiving a set value of the dampening medium, a second input for receiving an actual value of the dampening medium from he measuring means, and an output representing a control deviation connected to an input of the controller, the controller having an amplification factor which is adjustable by means of an adjusting value $K_R$ being applied to an amplification factor control input of said controller, said controller being operative for adjusting the amount of dampening medium between an actual value and a set value of dampening medium on the printing plate, comprising the steps of:

(a) in a first case of dampening medium deviations of the actual value from the set value wherein the set value of the dampening medium is greater than the actual value, setting the amplification factor to a greater amplification factor; and (b) in a second case of dampening medium deviations wherein the set value of the dampening medium is less than the actual value, setting the amplification factor to a smaller amplification factor.

21. Method according to claim 20, wherein the greater amplification factor is greater than the smaller amplification factor by a factor in the range of 1.2 to 2.0.

22. Method according to claim 20, comprising the step of changing the amount of dampening medium on the printing plate only in case the difference between the set value and the actual value is greater than a given tolerance.

23. Method according to claim 20, comprising the step of determining presence of a disturbance in the measured dampening medium amount, determining the effect of the disturbance, and adjusting the amount of dampening medium by an amount corresponding to the effect of the disturbance in the measured dampening medium amount.

24. Method according to claim 23, including a further summing location having a first input connected to an output of said controller, a second input connected to a compensation circuit for receiving a speed compensation signal, and an output connected to a dampening ductor, further comprising the step of superimposing on the output of the controller the compensation signal commensurate with the measured amount of the disturbance.

25. Method according to claim 24 including a computer coupled to the controller, comprising the step of computing with the speed computer the compensation signal.

26. Method according to claim 25, comprising the step of superimposing on the input of the adjusting apparatus a compensation signal commensurate with the measured amount of the disturbance.

27. Method according to claim 24 including curve reading apparatus coupled to the controller, comprising the step of automatically determining the compensation signal on the basis of compensation value curves.

28. Method according to claim 24 including a proportional-integral controller coupled to the controller, comprising the step of processing the determined amount of dampening medium through the controller.

29. Method according to claim 20 including optical apparatus for measuring light reflection from a dampened surface, comprising the step of determining the actual value by means of optical measurement by the optical apparatus of light reflections in the dampening medium on the printing plate.

* * * * *